US005398656A

United States Patent [19]

Brisbane et al.

[11] Patent Number: 5,398,656

[45] Date of Patent: Mar. 21, 1995

[54] REVERSIBLE SOCKET FUEL METER BODY

[75] Inventors: Roger M. Brisbane, Spencerport; Michael R. Brosseau, Rochester, both of N.Y.

[73] Assignee: General Motors Corporation, Detroit, Mich.

[21] Appl. No.: 286,355

[22] Filed: Aug. 5, 1994

[51] Int. Cl.[6] ..... F02M 55/02

[52] U.S. Cl. ..... 123/470; 123/456

[58] Field of Search ..... 123/456, 470, 468, 469, 123/472, 447, 452, 458, 184.21; 239/585.1, 585.3, 600

[56] References Cited

U.S. PATENT DOCUMENTS

| | | | |
|---|---|---|---|
| 4,475,486 | 10/1984 | Kessler | 123/184.21 |
| 4,895,124 | 1/1990 | Bartholomew | 123/468 |
| 4,924,834 | 5/1990 | Bonfiglioli | 123/470 |
| 5,069,186 | 12/1991 | Illien | 123/456 |
| 5,082,184 | 1/1992 | Stettner et al. | 239/408 |
| 5,154,623 | 10/1992 | Ehrentraut | 123/470 |
| 5,261,375 | 11/1993 | Rush | 123/470 |
| 5,309,885 | 5/1994 | Rawlings | 123/184.21 |
| 5,312,050 | 5/1994 | Schumann et al. | 239/585.1 |

OTHER PUBLICATIONS

SAE Technical Paper Series 920295, "Central Port Fuel Injection" Feb. 24–28, 1992, pp. 63–70.

*Primary Examiner*—Carl S. Miller

*Attorney, Agent, or Firm*—Karl F. Barr, Jr.

[57] ABSTRACT

An integrated fuel system for use in an internal combustion engine has a fuel meter body including a first, upper housing and a second, lower housing which are joined along a sealing flange to define a fuel plenum therebetween. The upper and the lower housings each have fuel injector sockets in opposed pairs; each injector socket in the upper housing opposing a corresponding socket in the lower housing. The sockets open through the respective housing walls and are configured to reversibly capture a fuel injector between each pair. The reversible mounting of the injectors within the fuel plenum facilitate fuel delivery from two sides of the fuel meter body to thereby simplify fuel distribution in a small fuel intake. A novel mounting configuration for the fuel meter body within the intake manifold is also disclosed.

5 Claims, 3 Drawing Sheets

REVERSIBLE SOCKET FUEL METER BODY

TECHNICAL FIELD

This invention relates to a fuel injection system for an internal combustion engine in which a plurality of injection nozzles discharge fuel adjacent the engine inlet ports and individual injectors, operating from a fuel plenum, meter fuel to the injection nozzles.

BACKGROUND

In the fuel injection system set forth in co-pending patent application U.S. Ser. No. 08/168,306 filed on Dec. 17, 1993 and owned by the assignee of the present invention, a fuel injection system is disclosed which has a fuel meter body for housing a plurality of electromagnetic fuel injectors in a common fuel plenum which is supplied by fuel from a regulated source. The fuel meter body is designed for placement in a central location, relative to the engine cylinders, and supplies fuel to the cylinders through a series of flexible fuel delivery tubes associated with the outlet of each, plenum mounted, fuel injector. Location of the solenoid portion of the fuel metering system, remote from the point of fuel delivery, supports a smaller terminal unit which enhances the positioning and targeting of the fuel while allowing sequential fueling of each engine cylinder.

The fuel meter body heretofore used has consisted of a single piece casting having sides a top and a bottom portion defining an internal fuel plenum. Cylindrical openings extending through the body facilitate the insertion of the injectors. An injector retaining plate holds the injectors in place and prevents extrusion of the injectors from the fuel meter body under the force of pressurized fuel within the plenum. Such an installation technique requires that the sealing surface, at the insertion end of the cylindrical openings, correspond with the largest diameter of the injector to facilitate insertion. The large diameter sealing surface creates a larger leakage path and, in addition, increases the overall size and volume of the fuel meter body.

SUMMARY OF THE INVENTION

The present invention is directed to a fuel injection system having a two piece fuel meter body which functions as the system chassis for the mounting of the primary fuel system components. The fuel meter body houses a plurality of individual, electromagnetic fuel injectors in a common fuel plenum defined between the two body members. The plenum is supplied with fuel such that pressure variabilities between the injectors are minimized. The upper and lower housing members which comprise the fuel meter body are configured with pairs of opposed injector sockets in opposed walls of the opposing members. Electromagnetic fuel injectors are captured between the two housing members, within the opposing injector sockets. The socket depth limits injector movement and positions the injectors properly for external connection of fuel conduits, with respect to the injector outlets, and electrical connections, with respect to the electrical terminal ends.

By capturing the injectors between two housing members, fuel sealing about the injector perimeters can occur at the ends of the injectors rather than along the largest diameter portion, required when the injector must be inserted from one end of the fuel body. As a result, the injectors may be placed in closer proximity to each other in the body to thereby provide a smaller, more packagable unit. In addition, by sealing the fuel meter body at the injector ends, the sealing diameter can be made equal in each socket. As a result, each fuel injector is capable of being reversibly mounted within the fuel meter body to accommodate the configuration of the engine intake. Fuel from one injector may be discharged from one side of the fuel meter body while fuel from an another fuel injector may be discharged from the opposite side of the fuel meter body.

The present invention discloses a fuel system having a compact and flexible two piece fuel metering body which delivers fuel to a plurality of engine cylinders in a sequential manner through flexible fuel conduits supplied by individual electromagnetic fuel injectors which are reversibly mounted within opposing injector sockets in opposing sides of a fuel meter body. The fuel meter body, being constructed of two separate housings, facilitates the reversible mounting arrangement of the injectors by allowing the sockets to seal along equal diameter end portions of each injector.

These and other features, objects, and advantages of the invention will be more apparent by reference to the following description and to the drawings.

DESCRIPTION OF THE PREFERRED EMBODIMENT

In the following description, the disposition of the fuel meter body in a manifold will vary from the positioning shown in the individual figures and, as such, the use of terms such as "top" and "bottom" relate to the drawings and are adopted for purposes of description only.

Figure 1:
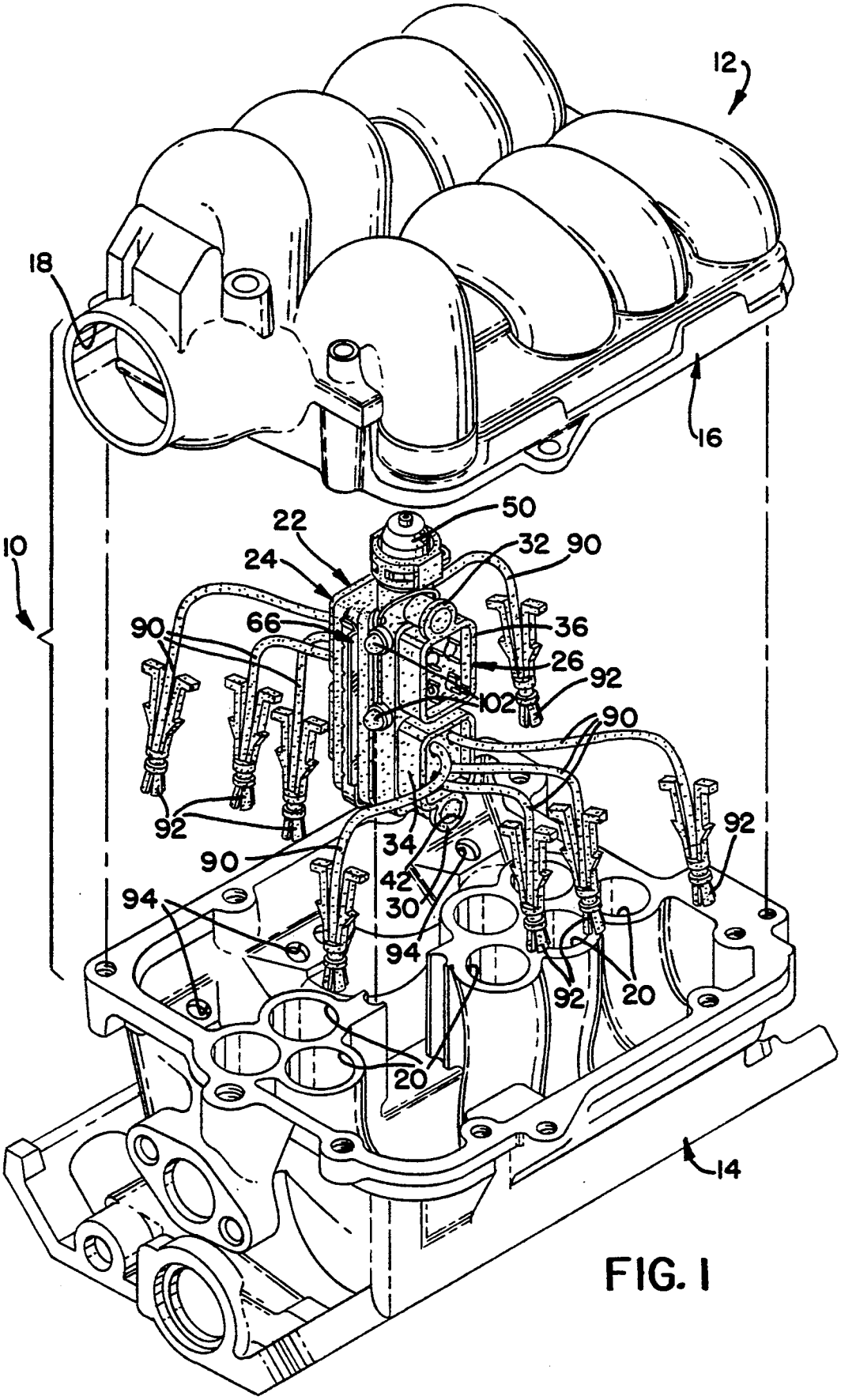
FIG. 1 is a perspective view of an intake system incorporating the novel fuel system of the present invention.

In FIG. 1 there is illustrated an intake system 10 of an internal combustion engine (not shown). The intake system 10 is generally constructed as a two-piece manifold assembly 12 which includes a lower, or base member 14 which is fixed to the engine and an upper, cover member 16 which closes the lower member and includes an air intake 18 for conducting air into the system. When assembled, the manifold assembly 12 defines a plurality of closed intake runners 20 for conducting air from intake 18 to the intake ports of the engine cylinders. Configured for assembly into the manifold 12 is a fuel meter body 22 for supplying fuel to the intake ports of the engine where the fuel is combined with the air from the intake runners.

Figure 2:
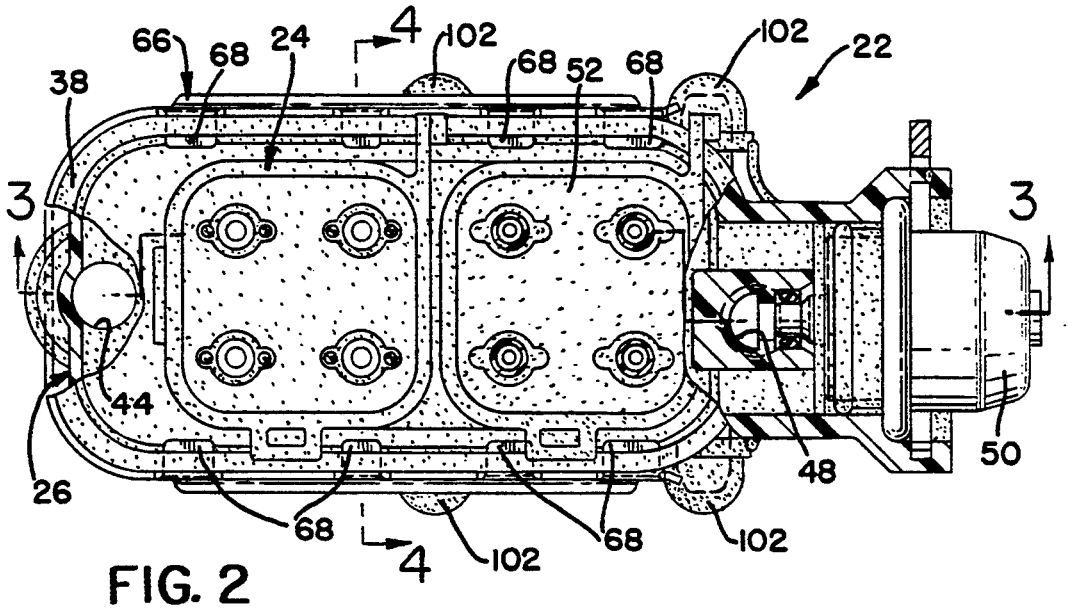
FIG. 2 is a top view, partially in section, of a fuel meter body of the present invention.
Figure 3:
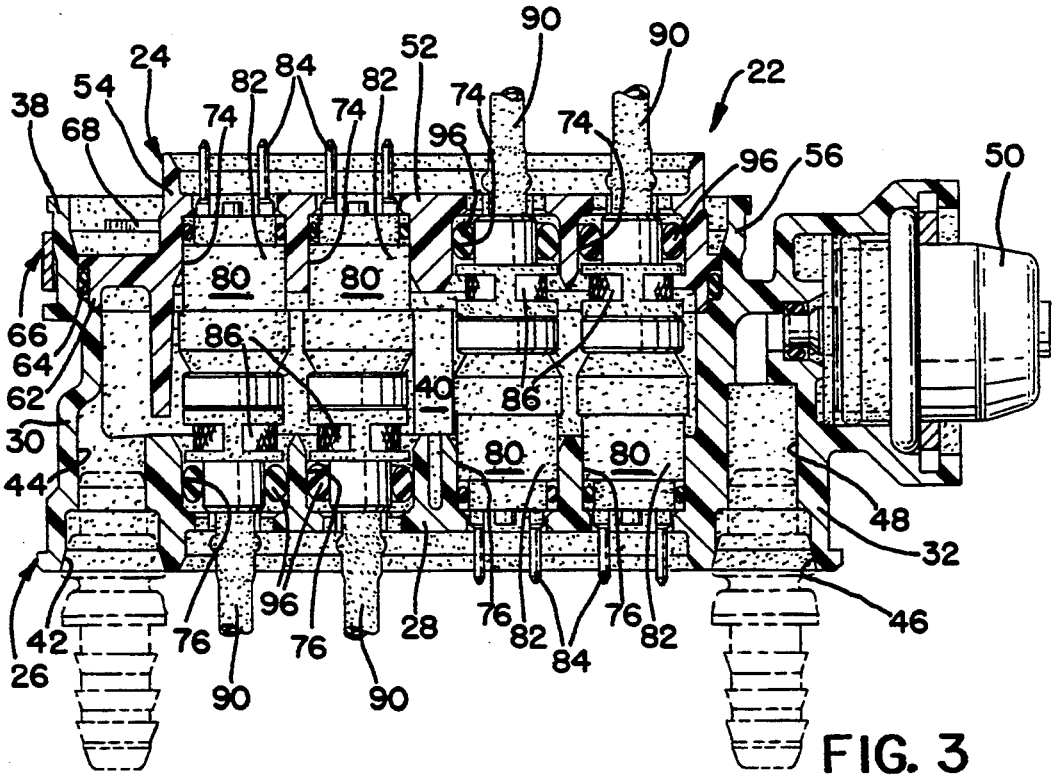
FIG. 3 is a sectional view of the fuel meter body of FIG. 2 taken along line 3—3 of FIG. 2.
Figure 4:
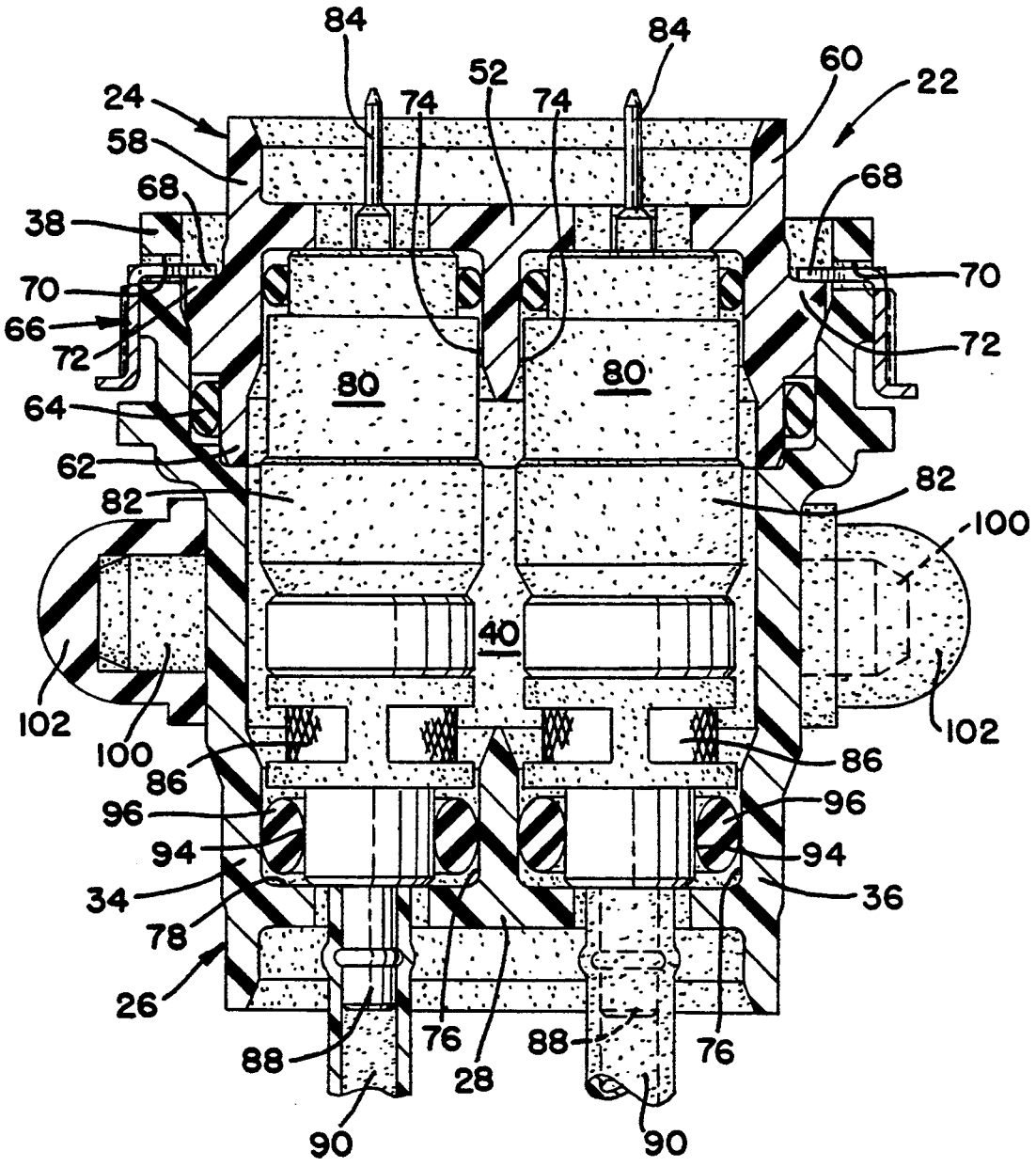
FIG. 4 is a sectional view of the fuel meter body of FIG. 2 taken along line 4—4 of FIG. 2.

The fuel meter body 22, shown in detail in FIGS. 2, 3 and 4 includes a first, upper housing member 24 and a second, lower housing member 26. Lower housing member 26 includes a bottom 28, sides 30,32,34,36 and an opened top having a flanged lip 38 extending about the perimeter thereof. The bottom 28 and sides, 30,32,34,36 cooperate to define the lower portion of a fuel plenum 40 within the fuel meter body 22. A fuel inlet 42 integral with side 30 communicates, through passage 44, to introduce fuel from a pressurized source (not shown) to the fuel plenum 40. Similarly, fuel outlet 46, in side 32, communicates through passage 48, to return fuel from the plenum 40 to the fuel source. Disposed intermediate of the plenum 40 and the fuel outlet 46, in fuel passage 48, fuel pressure regulator 50 is operable to limit fuel return through passage 48 to a desired pressure.

First, upper housing member 24 includes a top 52, sides 54,56,58,60 and an opened bottom having a flanged lip 62 extending around the perimeter thereof. The flanged lip 62 of the first, upper housing member 24 is configured to cooperate with the flanged lip 38 of the second, lower housing member 26 to close fuel plenum 40. A resilient sealing member such as gasket 64 is situated between the flanged lip 62 of the upper housing 24 and the flanged lip 38 of the lower housing 26 to assure a leak free seal. Likewise, a retaining member such as clip 66 may be utilized to ensure positive engagement of the two members. The clip 66 has locking tabs 68 which pass through openings 70 in the lower housing member 26 to positively engage corresponding shoulders 72 on the sides 58,60 of the upper housing member 24 to prevent separation of the two components upon introduction of pressurized fuel into the fuel plenum 40.

The top 52 of the first, upper housing member 24 and the bottom 28 of the second, lower housing member 26 oppose one another in a substantially parallel orientation across the fuel plenum 40. Opening through the top 52 and the bottom 28 wall portions are upper injector sockets 74 and lower injector sockets 76, respectively. The upper injector sockets 74 open through the top wall 52 of the first, upper housing 24 and the lower injector sockets 76 open through the bottom wall 28 of the second, lower housing 26. In each case, an upper injector socket 74 corresponds with, and is directly opposed to, a lower injector socket 76 across the fuel plenum 40, as can best be seen in FIGS. 3 and 4. The upper and the lower sockets 74,76 are configured as equal diameter, stepped cylindrical walls which open into the fuel plenum 40 and have integral shoulder or stop portions 78 extending into the sockets. In particular, it is to be noted that the upper sockets 74 formed in the top 52 of the first, upper housing member 24 are similarly configured to the lower sockets 76 extending through the bottom 28 of the second, lower housing member 26.

A solenoid operated, electromagnetic fuel injector 80, FIG. 4, has a body 82 housing a solenoid operated valve member, not shown. An integral electric connector 84 extends from a first end of the injector 80 and allows the unit to be connected to a source of controlling electrical power. Fuel enters the fuel injector 80 through inlets 86 which extend about the perimeter of the injector body 82. A second end of the injector has an outlet 88 in communication with injector fuel inlets 86 through the solenoid operated valve member. The outlet 88 is configured to receive one end of a flexible fuel line 90. The second end of the fuel line 90 terminates in a poppet nozzle 92. The poppet nozzle 92 is configured to be received in an opening 94 which communicates with an associated intake runner 20 in manifold assembly 12. Upon electrical actuation of an injector 80 through its associated electrical connectors 84, the solenoid actuated valve member meters fuel entering the injector inlets 86 through the injector to the outlet 88 in the form of pulses of pressurized fuel. The pressurized fuel pulses travel through the flexible fuel line 90 and to the poppet nozzle 92 where the pulsed nature of the fuel supply causes the poppet to open and close in a manner which delivers the metered fuel synchronously with the opening of its associated engine intake valve. Adjacent the first and second ends of each injector 80 are annular sealing collars 94 configured to receive resilient sealing members such as o-rings 96. The sealing collars 94 have diameters which are smaller than the largest diameter portion of the injector 80.

Returning to the fuel meter body 22, a plurality of fuel injectors 80, equal in number to the number of pairs of corresponding injector sockets 74,76 are selected for installation therein. Each pair of cylindrical, upper and lower injector sockets 74,76 are configured to capture a single fuel injector 80 therebetween when the first, upper housing 24 is engaged with the second, lower housing 26 to define the closed fuel plenum 40, see FIGS. 3 and 4. The cylindrical, opposed sockets 74,76 have diameters which correspond to the diameters of the sealing collars 94, on the first and second ends of each injector such that a leak free seal is established between each injector and its associated socket when the injector is installed with its corresponding o-ring 96. Each injector 80 is limited as to the extent of travel within each socket by the shoulder stops of sealing collars 94 in the respective sockets. Each pair of opposed injector sockets 74,76 cooperates to support an injector 80 within the plenum 40 such that the injector ends are firmly supported to prevent movement while the body 82 of the injector and, in particular, the fuel inlet openings 86, are positioned to communicate freely with pressurized fuel in plenum 40 of the fuel meter body 22.

To provide maximum flexibility in the application of the present fuel meter body 10 to a wide range of engine intake configurations, the disclosed fuel meter body facilitates reversible installation of each injector 80 in its respective pair of opposed sockets 74,76. The reversible installation of each fuel injector 80 shown in FIGS. 2 and 3 allows fuel to be delivered from both sides of the fuel meter body 22 to facilitate the routing of the flexible fuel lines 90 in an engine intake system 10 having severe space limitations.

The reversible mounting feature is not available on fuel meter bodies having a single piece fuel meter body in which the injectors are installed through openings in only one side of the body. In such a case, because the largest diameter of the injector must pass through the opening, it must also be the sealing diameter. As a result, a larger sealing diameter is required at one end of the injector which does not facilitate reversible mounting of the injectors. In addition, the large sealing diameter of the injectors in such a case requires a larger spacing between each injector resulting in an undesirably large fuel meter body.

In the fuel meter body 10 of the present invention, placement of the sealing surfaces adjacent the ends of the injectors 80, allows the injectors to be placed in closer proximity to one another along their larger diameter, center portions. As a result of the closer placement of the injectors, the plenum size and volume of the fuel meter body is reduced, aiding packaging and fuel handling.

In FIG. 1, the fuel meter body 22 of the present invention is shown mounted in an engine intake 10 utilizing a novel mounting apparatus that takes advantage of the reversible injector mounting features described above. Mounting studs 100 protrude outwardly from the exterior surface of the fuel meter body 22 and preferably receive caps 102 of a flexible, elastomeric material. The capped mounting studs 100 are configured to engage a slotted opening or bulkhead 104 in the manifold assembly 12. In the embodiment shown in FIG. 1, flexible fuel delivery lines 90 and their associated popper nozzles 92 exit both sides of the fuel meter body 22 to facilitate the fueling of an eight cylinder V-configured engine.

The present invention discloses a fuel system for an internal combustion engine having a compact fuel metering body which, when mounted within a space constrained intake manifold, facilitates the fueling of the individual engine cylinders. The fuel system includes a fuel meter body with a fuel plenum in which a plurality of fuel injectors can be reversibly mounted. As a result of the mounting flexibility of the injectors, fuel may be delivered from both sides of the fuel meter body thereby simplifying the mounting of the unit in the intake and the fueling of the engine cylinders.

In addition, the present invention discloses a fuel meter body having a provision for simplified mounting within the bulkhead of the intake manifold. Special mounting studs on the fuel meter body are received in a slotted bulkhead in the manifold and act to support eh fuel meter body therein.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is considered exemplary, rather than limiting, and the true scope is that described in the following claims.

The embodiments of the invention in which an exclusive property or privilege is claimed are defined as follows:

1. A fuel system for an internal combustion engine having a fuel meter body comprising a first housing member joined to a second housing member to define a fuel plenum therebetween, an electromagnetic fuel injector comprising a first, solenoid end portion having an integral electrical connector, and a second, fuel outlet end portion configured to deliver fuel, said fuel meter body further comprising a first wall integral with said first housing member and a second wall, opposed to said first wall, integral with said second housing member, said walls having a pair of coaxially opposed, equal diameter injector sockets opening therethrough, said opposed injector sockets enclosing, in a first mounting configuration, one of either of said first or second ends of said fuel injector to thereby support said injector in said plenum, wherein said electrical connector extends through one of said pair of opposed injector sockets and out of its associated wall and said fuel outlet end portion extends through said other of said pair of opposed sockets and out of its associated opposed wall and wherein said injector mounting configuration may be reversed.

2. A fuel system for an internal combustion engine having a fuel meter body comprising a first housing member joined to a second housing member to define a fuel plenum therebetween having a fuel inlet and a fuel outlet, an electromagnetic fuel injector comprising a first, solenoid end portion having an integral electrical connector, and a second, fuel outlet end portion configured to deliver fuel, said fuel meter body further comprising a first wall integral with said first housing member and a second wall, opposed to said first wall, integral with said second housing member, said walls having a pair of coaxially opposed, equal diameter injector sockets opening therethrough, said first and second housing members capturing said injector between said pair of opposed injector sockets, to thereby support said injector in said fuel plenum, said injector reversibly mounted by said injector sockets such that said electrical connector extends through one of said pair of opposed injector sockets and out of its associated wall and said fuel outlet end portion extends through said other of said pair of opposed sockets and out of its associated opposed wall and wherein said mounting direction is reversible.

3. A fuel system for an internal combustion engine having a fuel meter body comprising an upper housing member joined to a lower housing member to define a fuel plenum therebetween, said upper housing member comprising an upper wall bounding a portion of said fuel plenum and said lower housing member comprising a lower wall bounding a portion of said plenum, said lower wall opposed to said upper wall across said plenum, said fuel meter body further comprising first and second pairs of cylindrical, equal diameter, coaxially opposed upper and lower fuel injector sockets opening through said opposed upper and lower walls, said fuel system further comprising first and second electromagnetic fuel injectors comprising a first, solenoid end portion having an integral electrical connector, and a second, fuel outlet end portion, said first pair of fuel injector sockets enclosing, in a first mounting configuration, one of either of said first or second end portions of said first fuel injector to thereby support said injector in said plenum, wherein said electrical connector extends through one of said pair of opposed injector sockets and out of its associated wall and said fuel outlet end portion extends through said other of said pair of opposed sockets and out of its associated opposed wall and said second pair of fuel injector sockets enclosing, in a second mounting configuration, one of either of said first or second ends of said second fuel injector to thereby support said injector in said plenum, wherein said electrical connector extends through one of said pair of opposed injector sockets and out of its associated wall and said fuel outlet end portion extends through said other of said pair of opposed sockets and out of its associated opposed wall.

4. A fuel system for an internal combustion engine having a fuel meter body comprising an upper housing member sealingly joined to a lower housing member to define a fuel plenum therebetween having a fuel inlet and a fuel outlet, said upper housing member comprising an upper wall bounding a portion of said fuel plenum and said lower housing member comprising a lower wall bounding a portion of said plenum, said lower wall opposed to said upper wall across said plenum, said fuel meter body further comprising first and second pairs of cylindrical, equal diameter, coaxially opposed upper and lower fuel injector sockets opening through said opposed upper and lower walls, each of said fuel meter sockets having a stop disposed at the inner end thereof, said fuel system further comprising first and second electromagnetic fuel injectors comprising a first, solenoid end portion having an integral electrical connector, and a second, fuel outlet end portion configured to receive a fuel conduit, said upper and said lower housing members capturing, between said stops in said first pair of fuel injector sockets, in a first mounting configuration, one of either of said first or second end portions of said first fuel injector, to thereby support said injector in said plenum, wherein said electrical connector extends through one of said pair of opposed injector sockets and out of its associated wall and said fuel outlet end portion extends through said other of said pair of opposed sockets and out of its associated opposed wall and said upper and said lower housing members capturing, between said stops in said second pair of fuel injector sockets, in a second mounting configuration, one of either of said first or second ends of said second fuel injector to thereby support said injector in said plenum, wherein said electrical connector extends through one of said pair of opposed injector sockets and out of its associated wall and said fuel outlet end portion extends through said other of said pair of opposed sockets and out of its associated opposed wall.

5. A fuel system for an internal combustion engine having a fuel meter body comprising an upper housing member joined to a lower housing member to define a fuel plenum therebetween, said upper housing member comprising an upper wall bounding a portion of said fuel plenum and said lower housing member comprising a lower wall bounding a portion of said plenum, said lower wall opposed to said upper wall across said plenum, said fuel meter body further comprising first and second pairs of cylindrical, equal diameter, opposed upper and lower fuel injector sockets opening through said opposed upper and lower walls, said fuel system further comprising first and second electromagnetic fuel injectors comprising a first, solenoid end portion having an integral electrical connector, and a second, fuel outlet end portion configured to receive a fuel conduit, said first and second end portions having equal diameters, said first fuel injector reversibly mounted within said first pair of opposed fuel injector sockets wherein said electrical connector extends through one or the other of said pair of opposed injector sockets and out of its associated wall and said fuel outlet end portion extends through said other of said pair of opposed sockets and out of its associated opposed wall and said second fuel injector reversibly mounted within said second pair of opposed fuel injector sockets wherein said electrical connector extends through one or the other of said pair of opposed injector sockets and out of its associated wall and said fuel outlet end portion extends through said other of said pair of opposed sockets and out of its associated opposed wall.

* * * * *